US009428893B1

(12) United States Patent
Towers

(10) Patent No.: US 9,428,893 B1
(45) Date of Patent: Aug. 30, 2016

(54) DRAIN TRAP

(71) Applicant: PLYMOUTH I.P. CONCEPTS LLC, Cheyenne, WY (US)

(72) Inventor: Patrick Allison Towers, San Tan Valley, AZ (US)

(73) Assignee: PLYMOUTH I.P. CONCEPTS LLC, Cheyenne, WY (US)

( * ) Notice: Subject to any disclaimer, the term of this patent is extended or adjusted under 35 U.S.C. 154(b) by 13 days.

(21) Appl. No.: 14/644,402

(22) Filed: Mar. 11, 2015

Related U.S. Application Data

(63) Continuation-in-part of application No. 29/503,482, filed on Sep. 26, 2014, now Pat. No. Des. 745,950.

(60) Provisional application No. 61/951,796, filed on Mar. 12, 2014, provisional application No. 62/056,653, filed on Sep. 29, 2014.

(51) Int. Cl.
*E03C 1/12* (2006.01)
*E03C 1/26* (2006.01)

(52) U.S. Cl.
CPC ..... *E03C 1/26* (2013.01)

(58) Field of Classification Search
CPC ..... E03C 1/26
USPC ..... 4/679
See application file for complete search history.

(56) References Cited

U.S. PATENT DOCUMENTS

| | | | | | |
|---|---|---|---|---|---|
| 1,817,376 | A | | 6/1929 | Izquierdo | |
| 1,958,712 | A | * | 5/1934 | Nance | E03C 1/29 137/247.35 |
| 2,742,101 | A | * | 4/1956 | Stambaugh | E03C 1/284 137/247.41 |
| 4,158,897 | A | * | 6/1979 | Cocherel | E03C 1/29 137/247.35 |
| 4,199,827 | A | * | 4/1980 | Tuleja | E03C 1/284 4/289 |
| 4,539,718 | A | | 9/1985 | Haer | |
| 4,700,412 | A | | 10/1987 | Manuel | |
| 5,038,816 | A | | 8/1991 | Weltsch | |
| 5,159,724 | A | * | 11/1992 | Vosper | E03C 1/284 137/247.35 |
| 5,638,557 | A | | 6/1997 | Iida et al. | |
| 6,153,095 | A | | 11/2000 | Francisco | |
| 6,308,350 | B1 | | 10/2001 | Marchionda | |
| 7,128,834 | B2 | | 10/2006 | Davenport | |
| 2002/0088051 | A1 | * | 7/2002 | Nunez | E03C 1/29 4/679 |
| 2005/0229305 | A1 | * | 10/2005 | Nocera | E03C 1/29 4/679 |
| 2011/0145989 | A1 | | 6/2011 | Jan | |

* cited by examiner

*Primary Examiner* — Huyen Le
(74) *Attorney, Agent, or Firm* — Ralph D. Chabot

(57) ABSTRACT

A drain trap comprising a lid and bowl where the lid further comprises a central inlet flow tube which discharges into the bowl at a distance above the inner surface of the base of the bowl. Fluid entering through the flow tube and into the bowl fills the interior until the water level reaches the discharge opening to exit from the drain trap. Water flow is in the annular space between the inner surface of the bowl and the exterior surface of the tube.

4 Claims, 2 Drawing Sheets

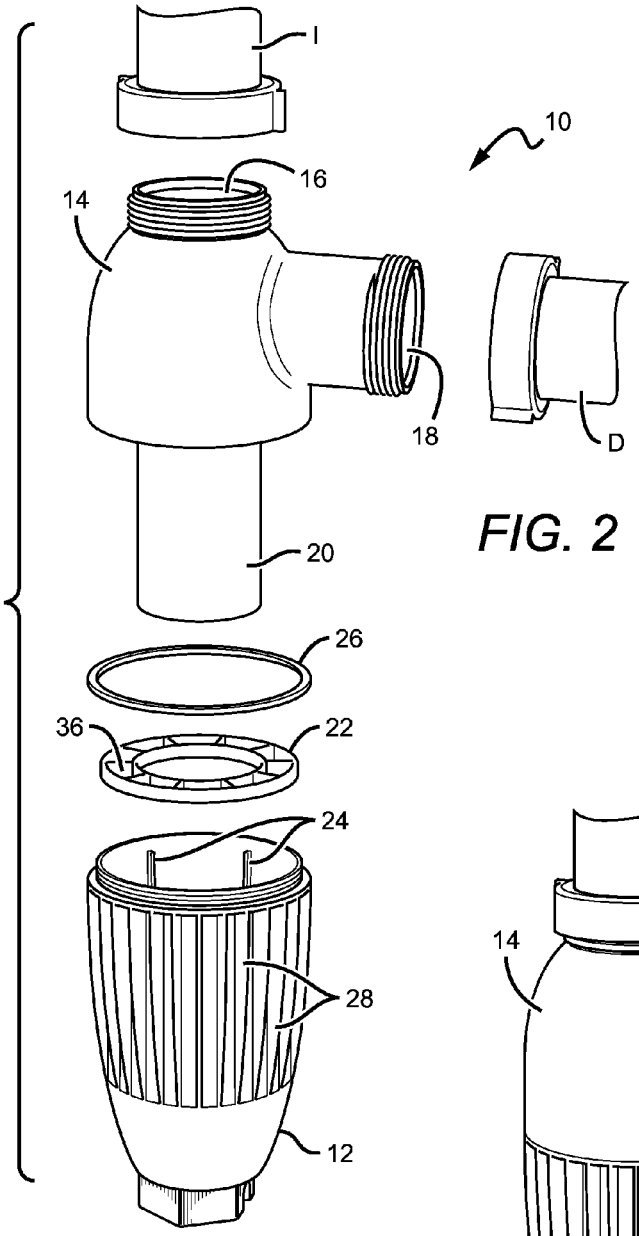
FIG. 2
FIG. 1
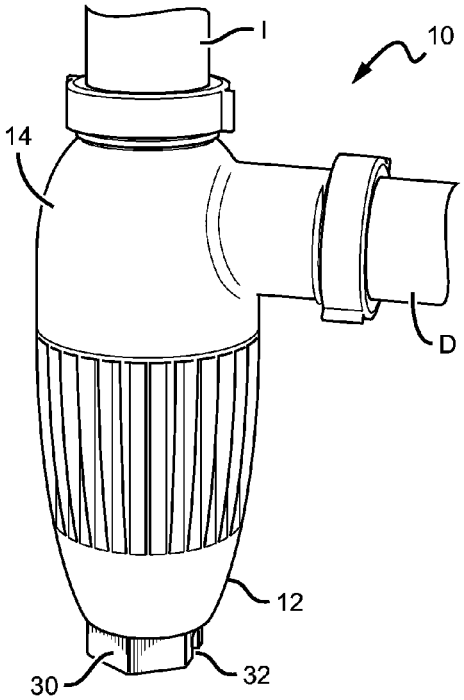

DRAIN TRAP

CROSS REFERENCE TO RELATED APPLICATIONS

This application claims benefit to U.S. Provisional Application No. 61/951,796 filed Mar. 12, 2014; U.S. Provisional Application No. 62/056,653 filed Sep. 29, 2014; and, U.S. Design Application No. 29/503,482 filed Sep. 26, 2014; the content of all applications are incorporated by reference herein in their entirety for all purposes.

BACKGROUND OF THE INVENTION

Traps have long been used in plumbing. Designs typically involve a two-fold purpose. First, a configuration to prevent sewer gas back flow through a drain line and second, a readily cleanable trap for among other purposes, the collection of heavier weight items, such as rings or other small jewelry which may have accidently been lost down a sink drain.

One example of such a trap is U.S. Pat. No. 4,700,412 issued to Manuel. Manuel teaches a universal trap containing inlet and outlet conduits connecting to a bowl. The bowl utilizes a center post to assist in securing the bowl to the lid. In operation, the bowl remains completely filled with drainage liquid, and the conduits are both partially filled. A screen element having approximately the same diameter as the inside diameter of the inlet conduit is horizontally positioned across the opened top portion of the bowl and serves to prevent any material larger than the screen mesh to be discharged through the outlet conduit. The universal trap is supported by a pair of ring couplings which are both offset from the vertical centerline. Sedimentation is likely to build up particularly in the area behind the center post opposite the discharge point of the inlet conduit.

SUMMARY OF THE INVENTION

Presented is a new drain trap which is attached in-line to the discharge line downstream of an apparatus such as a sink or bath tub. It is an improvement over prior art P-traps or similar configurations. The device is distinct from what is commonly used in that it also serves as a filter to prevent heavier objects from being carried downstream.

The device comprises:

(1) an upper lid having an inlet tube and an outlet. The inlet tube is for operably receiving discharge fluids, solids and gasses which flow from a tub, sink or other apparatus where P-traps are commonly used. The outlet is operably connected to the downstream sewer line so that the fluids, lighter density solids and gasses can be discharged downstream; and, (2) a vertically elongated bowl removably attached to the lid and having an open top, an inner bottom surface, and a sidewall having a pre-determined length between the open top and the inner bottom surface.

When the bowl and lid are attached to one another, the inlet tube extends into the bowl between about 60% to about 80% the length of the sidewall. Importantly, the inlet tube is positioned to have a common axis of symmetry with the bowl whereby the space between the sidewall of the bowl and the exterior surface of the inner tube defines an annular region as illustrated generally in FIG. 3.

Optionally, a retainer disk orientated horizontally within the interior formed by the bowl and upper lid is disposed and having a plurality of slots and a central aperture slightly larger than the outside diameter of the inlet tube.

The upper lid is connected at its inlet opening to the discharge line of, for example, a sink so that discharge from the sink will pass through the discharge line, flow into the inlet tube and exit the tube a distance above the inner bottom surface of the bowl.

The optional retainer disk can function as a filter or screen to prevent objects from exiting the drain trap. In one embodiment, the retainer disk would rest upon an inner circumferential lip formed about the bowl. The inlet tube carrying discharge into the device vertically extends down through the retainer disk and discharges into the vertically elongated bowl distal and below the retainer disk. In this manner, objects such as rings or coins will immediately settle upon the inner bottom surface of the bowl. The outlet for flow exiting the drain trap is integral with the upper lid and located above where the retainer disk would be positioned.

However, in a preferred embodiment, the retainer disk would not be utilized. Due to the elongation of the bowl, any object of appreciable density relative to water which flows into a sink drain or tub drain would travel into the device and down the inner tube and be deposited onto the bottom interior surface of the bowl.

Once the device is properly installed into the desired flow line, any sedimentation or hair and soap scum may tend to be deposited onto the bottom interior surface of the bowl would be lifted by the turbulence created by incoming water exiting the tube within the bowl. The turbulence thereafter would cause the suspended sediment to flow upwards in the annular region between the bowl sidewall and the outside diameter of the tube and out the discharge opening. If the tube is shorter than disclosed, undesired build-up of sedimentation is likely. Thus, my device provides a flow path which does not require an in-stream filter while still having the ability to retain objects lost down a sink drain.

A unique feature of my device is the abrupt change in the direction of water flow. Rather than a standard P-trap which incorporates a U-bend having piping of the same internal diameter, my device utilizes the annular region between the circumference of the tube and the internal sidewall of the bowl for which drain water is directed through.

Optionally, the exterior of the bowl comprises an enhanced gripping surface to more easily frictionally engage the bowl for detachment from the lid. In a most preferred embodiment, a plurality of vertical ribs are formed along the exterior circumference of the bowl which provides an enhanced gripping surface for disengaging the bowl-upper lid threaded connection. The lowermost portion of the bowl can be formed in a hexagonal configuration so that a wrench can be used to remove the bowl. Also, as part of the hexagonal configuration, a pair of slots 180 degrees apart from one another are formed for using a suitable screw driver or other linear object to rotate the bowl.

In a commercial embodiment of the device, both the lid and bowl include a locking tab perpendicularly extending away; each having an aperture and positioned near the engagement interface. When lid and bowl are threadably engaged and tightened, the apertures are aligned so a plastic strip or wire can be used to prevent disassembly of the device.

DESCRIPTION OF THE DRAWINGS

FIG. 1 is a perspective view of my device installed as part of a drainage line.

FIG. 2 is an exploded perspective view of the device of FIG. 1

DETAILED DESCRIPTION

Figure 3:
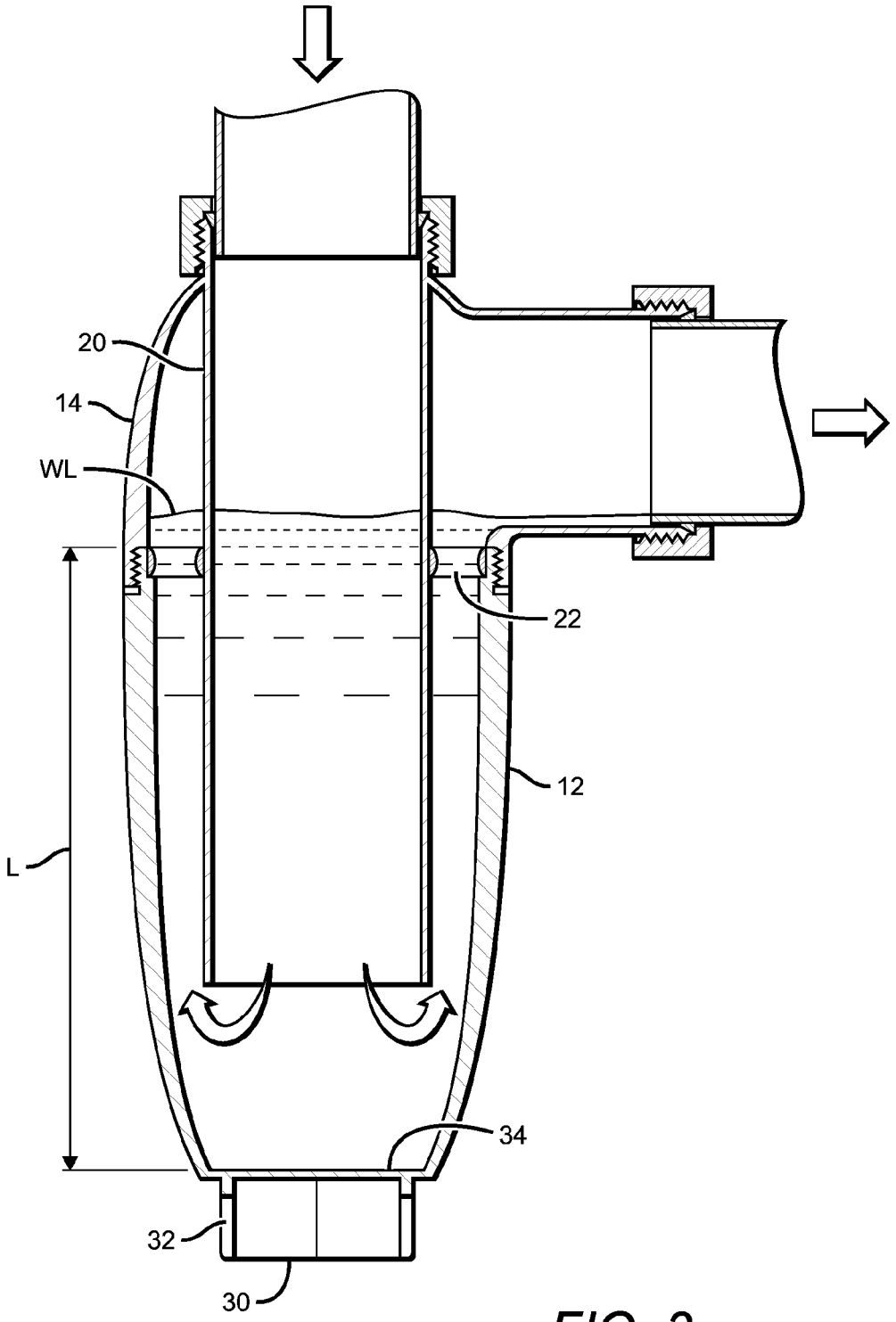
FIG. 3 is a sectional view of the device of FIG. 1

The figures are provided for illustration purposes and are not necessarily drawn to scale.

FIG. 1 illustrates the positioning of drain trap 10 as part of a drainage line having inlet conduit I and discharge conduit D threadably secured by couplings 11.

Drain trap 10 comprises a vertical elongated bowl 12 and a lid 14. Lid 14 includes an inlet 16, discharge 18 and a vertical tube 20 extending into the bowl 12. Viewing FIG. 3, L is the height of vertical elongated bowl 12 from the top edge to interior floor 34. The distal end 38 of tube 20 extends into bowl 12 between about 0.60 L-0.85 L and more preferably between about 0.75 L-0.81 L. This distance permits heavy objects to fall to interior floor 34 while still being close enough to floor 34 to disperse sedimentation and carry up through the annular region and out discharge line D.

Optionally, a retaining disk 22 can be positioned and rest upon a series of spaced apart lips 24 which extend inward from the inside sidewall of bowl 12 as illustrated in FIG. 2.

Bowl 12 has a general frustum shape as illustrated in FIG. 1. Bowl 12 has an open male-threaded top and an inner bottom surface 34. The diameter of bowl across the open top is greater than the diameter across the inner bottom surface 34. A reduced surface area across inner bottom surface 34 causes sedimentation to be deposited in a localized area resulting in easier dispersion when flow exiting the inner tube is of a sufficient velocity as when a sink is being drained of water.

Bowl 12 is threadably attached to lid 14. Preferably, threaded engagement comprises male threads on bowl 12 and female threads on lid 14. A suitably sized sealing O-ring 26 is disposed between bowl 12 and lid 14 to prevent leakage.

There are 2 connecting points to operatively attach drain trap 10. Both of these connector points have typical m.i.p. threading (male iron pipe). This threading is seen on every plumbing related part currently in use. Whether using galvanized pipe, pvc or abs, this is the preferred mode for connection of plumbing parts. This allows the end user to easily connect drain trap 10 with existing plumbing. Both connecting points preferably include a 1.5 inch line that is integral to the device construction and the inlet and discharge ports are equal regarding the inside diameter. This allows for equalized discharge of received waste water. This reduces or eliminates any back up and allows waste water to flow freely into the sewer line. The 1.5 inside diameter of inlet 16 and discharge 18 also allows for universal acceptance of either 1.25 or 1.5 inch feeder/discharge lines using couplings 11.

Inlet 16 of lid 14 is threadably attached to the sink discharge line I and discharge 18 of lid 13 is threadably attached to the downstream line D.

Bowl 12 further includes a plurality of spaced apart and vertically orientated elongated external ribs 28 which assist in gripping bowl 12 for tightening and unscrewing from lid 14. Other features which can alternatively assist with removal or tightening include a hexagon nut 30 integral with the bottom of bowl 12; and, hexagon 30 further having a pair of slots 32 180 degrees from one another, suitably sized to receive the shaft of a screwdriver or the like for application of rotational torque.

As can be viewed in FIG. 3, bowl 12 has upward extending elongated sidewalls from interior floor 34 which defines an annular space for water to flow toward discharge 18. In a preferred embodiment of the device, the internal diameter of bowl 12 is approx. 2.55 inches while the outside and inside diameters of tube 20 are approximately 1.59 inches and 1.42 inches respectively. Thus the approximate cross-sectional area of the annular region and tube interior are 3.1 sq. in and 1.59 sq. in respectively. The distance between the bowl sidewall and tube is approximately 0.48 in which is about ⅓ of the inside diameter of tube 20.

Once drain trap 10 is connected to and becomes part of the discharge line, water from a source such as a sink will enter vertical tube 20. Water will accumulate within drain trap 10 until the water level WL reaches equilibrium which is the level of discharge opening 18 and thereafter enters discharge line D to the sewer line (not shown). The arrows depicted in FIG. 3 represent the water flow into, through and out of drain trap 10. Device 10 has the threadable connection between bowl 12 and lid 14 near water level WL. In this design, when disconnection is desired, minimal water will be spilled with the majority being retained by bowl 12.

Periodically, or after the loss down the sink drain of a ring or other object, bowl 12 can be unscrewed from lid 14 and cleaned. If retaining disk 22 is used, it can be cleaned periodically of any debris which may be clogging the slots 36, if necessary. Any objects can also be removed from bowl 12. Bowl 12 can thereafter be reattached to lid 14 with the retaining disk (if used) and O-ring 26 positioned as before.

In a commercial embodiment, drain trap 10 will further include a pair of locking tabs 40 and 42; one located on bowl 12 and the other on conical lid 14 as shown in FIG. 1 and FIG. 2. Each tab includes an aperture A for alignment with the other tab. A locking mechanism is thereafter run through both apertures and must be removed before lid and bowl can be detached from one another.

I claim:

The invention claimed is:

1. A drain trap comprising:

an upper lid having an inlet tube to operably receive fluids, solids and gasses and an outlet to discharge the fluids, solids and gasses, said inlet tube extending away from said upper lid in a perpendicular direction over its entire length;

an elongated bowl having a general frustum shape removably attached to said upper lid and having an open top and an inner bottom surface; the diameter of said bowl across said open top being greater than the diameter across said inner bottom surface; said bowl further having a sidewall of pre-determined length between said open top and said inner bottom surface; and, when said bowl is attached to said lid, the inlet tube extends into said bowl between about 0.60 L to about 0.85 L where L is the pre-determined length of said sidewall;

said inlet tube is positioned to have a common axis of symmetry with said bowl whereby the space between said sidewall and the exterior surface of said tube defines an annular region;

said bowl further comprises a plurality of spaced elongated vertical ribs formed on the exterior surface of said sidewall and a hexagon nut integral with the bottom of said bowl, said hexagon nut further comprising a pair of slots located on opposing faces of said hexagon.

2. The drain trap of claim 1 where said removable attachment of said upper lid and said bowl is threadable engagement.

3. The drain trap of claim 1 further comprising an O-ring positioned between said upper lid and said bowl.

4. The drain trap of claim 1 where said bowl further comprises a locking tab having an aperture and said lid further comprises a locking tab having an aperture so that when said bowl and lid are removably attached, said apertures have a common axis of symmetry.

* * * * *